US009668539B2

(12) United States Patent
La Rochelle

(10) Patent No.: US 9,668,539 B2
(45) Date of Patent: Jun. 6, 2017

(54) FOOTWEAR WITH SOLE PROTECTION

(71) Applicant: Simon La Rochelle, Granby (CA)

(72) Inventor: Simon La Rochelle, Granby (CA)

( * ) Notice: Subject to any disclaimer, the term of this patent is extended or adjusted under 35 U.S.C. 154(b) by 329 days.

(21) Appl. No.: 13/763,863

(22) Filed: Feb. 11, 2013

(65) Prior Publication Data

US 2013/0205624 A1 Aug. 15, 2013

Related U.S. Application Data

(60) Provisional application No. 61/596,815, filed on Feb. 9, 2012.

(51) Int. Cl.

| | |
|---|---|
| ***A43B 7/32*** | (2006.01) |
| ***A43B 13/02*** | (2006.01) |
| ***A43B 13/10*** | (2006.01) |
| ***A43B 13/12*** | (2006.01) |
| ***A43B 23/08*** | (2006.01) |
| ***A43B 23/16*** | (2006.01) |
| *A43B 3/00* | (2006.01) |

(52) U.S. Cl.

CPC ..... *A43B 13/02* (2013.01); *A43B 7/32* (2013.01); *A43B 13/026* (2013.01); *A43B 13/10* (2013.01); *A43B 13/127* (2013.01); *A43B 23/086* (2013.01); *A43B 23/16* (2013.01); *A43B 3/0026* (2013.01)

(58) Field of Classification Search

CPC ..... A43B 3/0026; A43B 7/32; A43B 13/02; A43B 13/026; A43B 13/127; A43B 13/10; A43B 23/16; A43B 23/086

USPC ..... 36/25 R, 30 R, 30 A, 31

See application file for complete search history.

(56) References Cited

U.S. PATENT DOCUMENTS

| | | | | |
|---|---|---|---|---|
| 5,285,583 | A * | 2/1994 | Aleven | 36/44 |
| 5,926,977 | A | 7/1999 | Sanders | |
| 5,996,255 | A * | 12/1999 | Ventura | A43B 7/32 36/30 R |
| 6,167,639 | B1 * | 1/2001 | Ventura | 36/44 |
| 6,505,421 | B1 * | 1/2003 | Vaz | 36/30 R |
| 2006/0021257 | A1 * | 2/2006 | Hung | 36/73 |
| 2006/0211318 | A1 * | 9/2006 | Fenzi | A43B 7/32 442/181 |
| 2008/0282581 | A1 * | 11/2008 | Sartor | A43B 7/32 36/25 R |
| 2009/0000148 | A1 * | 1/2009 | Simmons | A43B 7/141 36/28 |
| 2009/0172971 | A1 * | 7/2009 | Peikert | A43B 7/125 36/88 |

FOREIGN PATENT DOCUMENTS

| | | | |
|---|---|---|---|
| WO | 9626655 | A1 | 9/1996 |

* cited by examiner

*Primary Examiner* — Jila M Mohandesi

(74) *Attorney, Agent, or Firm* — Norton Rose Fulbright Canada LLP

(57) ABSTRACT

The present disclosure relates to an item of footwear with sole protection. The footwear has an upper adapted to receive a foot of the wearer; a sole secured to the upper and adapted to be the interface between the wearer and the ground; and a puncture resistant layer embedded into the sole so as to provide the sole protection for the foot of the wearer, the puncture resistant layer having an outer edge exceeding an inner perimeter of the item of footwear defined by a junction between the upper and the sole.

8 Claims, 6 Drawing Sheets

PRIOR ART

FOOTWEAR WITH SOLE PROTECTION

CROSS-REFERENCE TO RELATED APPLICATION

The present application claims the priority of U.S. Provisional Application no. 61/596,815, incorporated herewith by reference.

FIELD OF THE APPLICATION

The present application relates to footwear and, more particularly, to footwear with sole protection.

BACKGROUND OF THE ART

A function of some types of footwear is to protect the foot sole of a wearer against penetration of nails, screws or other similar sharp and rigid objects through the sole of such footwear when the wearer steps on such items. Accordingly, some items of footwear include a sole protection.

In some items of footwear, sole protection is provided by a steel or like puncture resistant material as an insert or embedded into the sole of the item of footwear. More recently, non-metallic multi-layers puncture resistant insole board as also been developed, to provide more flexibility and insulation. According to some protective footwear standards, the steel or like puncture resistant material, where incorporated into the footwear, shall cover a minimal area of the sole, including the front and heel area, and shall be an integrated part of the footwear.

Referring to FIG. 1A, an item of footwear with sole protection is illustrated at 1 in accordance with the prior art. The item of footwear 1 has two parts: the upper illustrated at 2 and the sole 3 secured to the upper 2. A junction 4 between the upper 2 and the sole 3 defines an inner perimeter 5 of the item of footwear 1. The sole 3 includes an insole structure 6, a midsole structure 7 and an outsole 8. The sole protection is provided by an insole board 9 made of multi-layers puncture resistant laminated fabric.

However, the item of footwear illustrated in FIG. 1A is still subject to penetration of sharp and rigid objects through the sole 3 into the upper 2, adjacent the inner perimeter 5 of the item of footwear 1 defined about the junction 4 between the upper 2 and the sole 3, as illustrated by penetrating objects in FIG. 1B.

SUMMARY OF THE APPLICATION

It is therefore an aim of the present disclosure to provide a footwear with sole protection addressing issues associated with the prior art.

Therefore, in accordance with the present application, there is provided an item of footwear with sole protection comprising: an upper adapted to receive a foot of the wearer; a sole secured to the upper and adapted to be the interface between the wearer and the ground, an inner perimeter of the item of footwear defined by a junction between the upper and the sole; and a puncture-resistant layer connected to the sole so as to provide puncture protection for the foot of the wearer, the puncture resistant layer having an outer edge extends beyond at least a portion of the inner perimeter.

DESCRIPTION OF THE PREFERRED EMBODIMENTS

Figure 2:
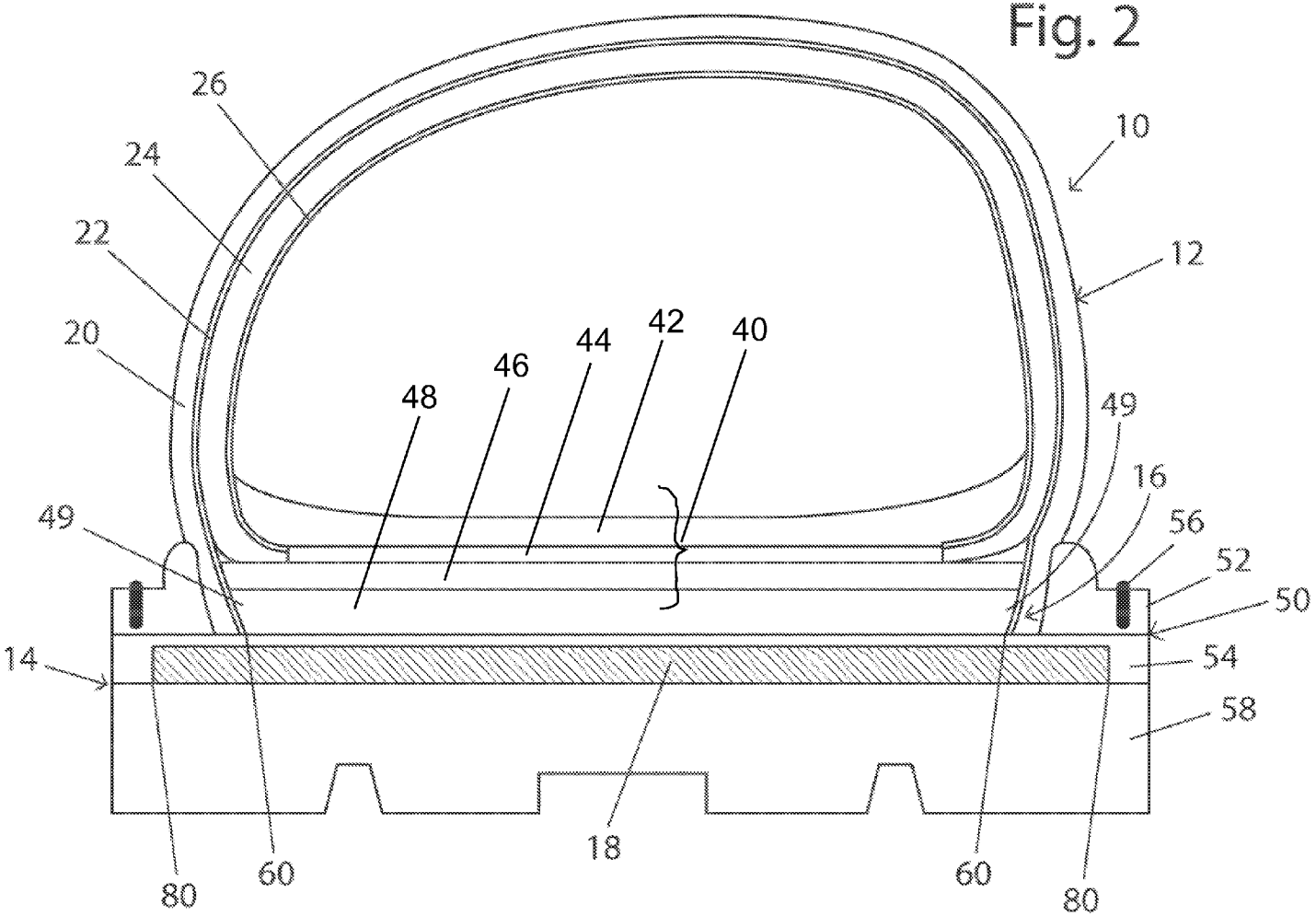
FIG. 2 is a front cross-section view of an item of footwear with sole protection in accordance with an aspect of the present disclosure.

Referring now to the drawings and more particularly to FIG. 2, an item of footwear with sole protection in accordance with one aspect of the present disclosure is shown at 10. The item of footwear is illustrated as being a work boot, but could also be any other type of footwear. The item of footwear 10 has two main parts: an upper illustrated at 12 and a sole 14 secured to the upper 12. A junction 16 between the upper 12 and the sole 14 defines an inner perimeter of the item of footwear 10. A puncture resistant layer 18 may be embedded into the sole 14, as described hereinafter. It is pointed out that the thickness of some of the layers is exaggerated in the figures (e.g., such as the thickness of the puncture resistant layers), to better illustrate the various layers.

The upper 12 is adapted to receive a foot of the wearer. The upper 12 may be composed of one or more layers of materials, such as, for example, leather, synthetic leather, nylon fabric, a combination of these materials and the like. The upper 12 has an outer layer 20, and may also comprises one or more of a backing reinforcement 22, a protective toe-cap 24, and/or an inner liner 26, among numerous other possibilities. The backing reinforcement 22 may be provided as a laminated layer to reinforce the outer layer 20. Materials used for the backing reinforcement 22 and the inner liner 26 are those known in the art of footwear. The above-referred construction is one of many possible constructions for the item of footwear 10.

The protective toe-cap 24 is a protective component (e.g. steel toe-cap or composite toe-cap) defining a shell accommodating the toes of the wearer in the item of footwear 10. The toe-cap 24 protects the toes from impacts of objects falling against the toe region of the item of footwear 10. The inner liner 26 is provided for enhanced comfort for the wearer to tolerate wearing the item of footwear 10 for longer periods.

The upper 12 also comprises an insole 40. As illustrated in FIG. 2, a removable sock liner 42 may be within the foot-receiving cavity of the upper, and lies on a top surface of the insole 40. By way of example, the insole 40 comprises various layers, such as insole layers 44, 46 and 48. The insole layer 44 may be made of cellulosic paper or synthetic non woven material. The insole layer 46 may be made of cushioning material such as urethane, latex and/or EVA, which provides wearing comfort of the item of footwear. The insole layer 48 may be an insole board. Any other configuration is considered for the insole 40, with one or more layers. As illustrated in FIG. 2, the upper 12 is connected at least along an outer edge 49 of the insole 40.

The sole 14 may comprise a single layer, or may be an assembly of separate layers of different materials. These layers may be made of natural rubber or a synthetic material. As illustrated in FIG. 2, in accordance with one of numerous possible embodiments, the sole 14 may be made of two different layers: a midsole 50 and the outsole 58. Although the upper 12 of the item of footwear 10 as shown in FIG. 2 is depicted as including the insole 40, it is to be understood that other sole configurations are possible, for instance with the insole 40 being part of the sole 14. Also, many constructions of the sole 14 are possible, with one or more layers.

The midsole 50 is connected to the upper 12. The midsole 50 may also comprises two superimposed portions: the welt 52 and the midsole layer 54. The welt 52 may be a strip of leather, rubber, plastic or polyurethane that may be connected the upper 12. As shown in FIG. 2, the welt 52 is connected by a direct injection molding process to the upper 12 and provides a decorative stitch line 56, that may include a decorative thread. The outsole 58 is adapted to be the interface between the wearer and the ground. The outsole adheres to the midsole 50, more specifically to the midsole layer 54. Other configurations are possible for the sole 14, as it may consist of a single layer, with or without the welt 52.

It is observed from FIG. 2 that the inner perimeter of the upper 12 is generally defined by the intersection between the upper 12 and the sole 14. The inner perimeter 60 may define the boundary delimiting the inner cavity of the upper 12 that receives the foot of the wearer. In other words, the inner perimeter 60, that define the boundary delimiting the inner cavity of the upper 12, corresponds to the shoelast's edge.

Figure 1A:
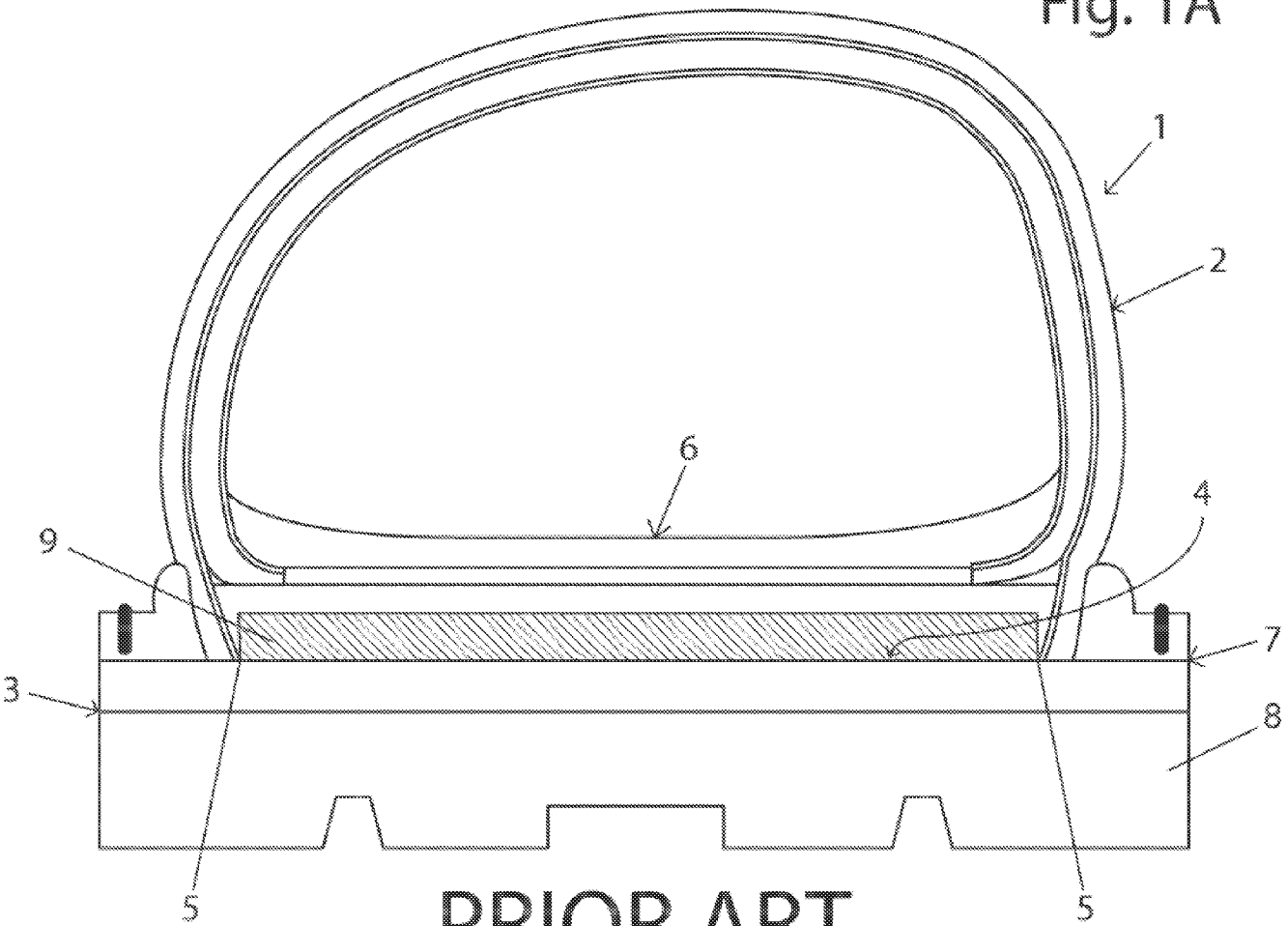
FIG. 1A is a front cross-section view of an item of footwear with sole protection in accordance with the prior art.
Figure 1B:
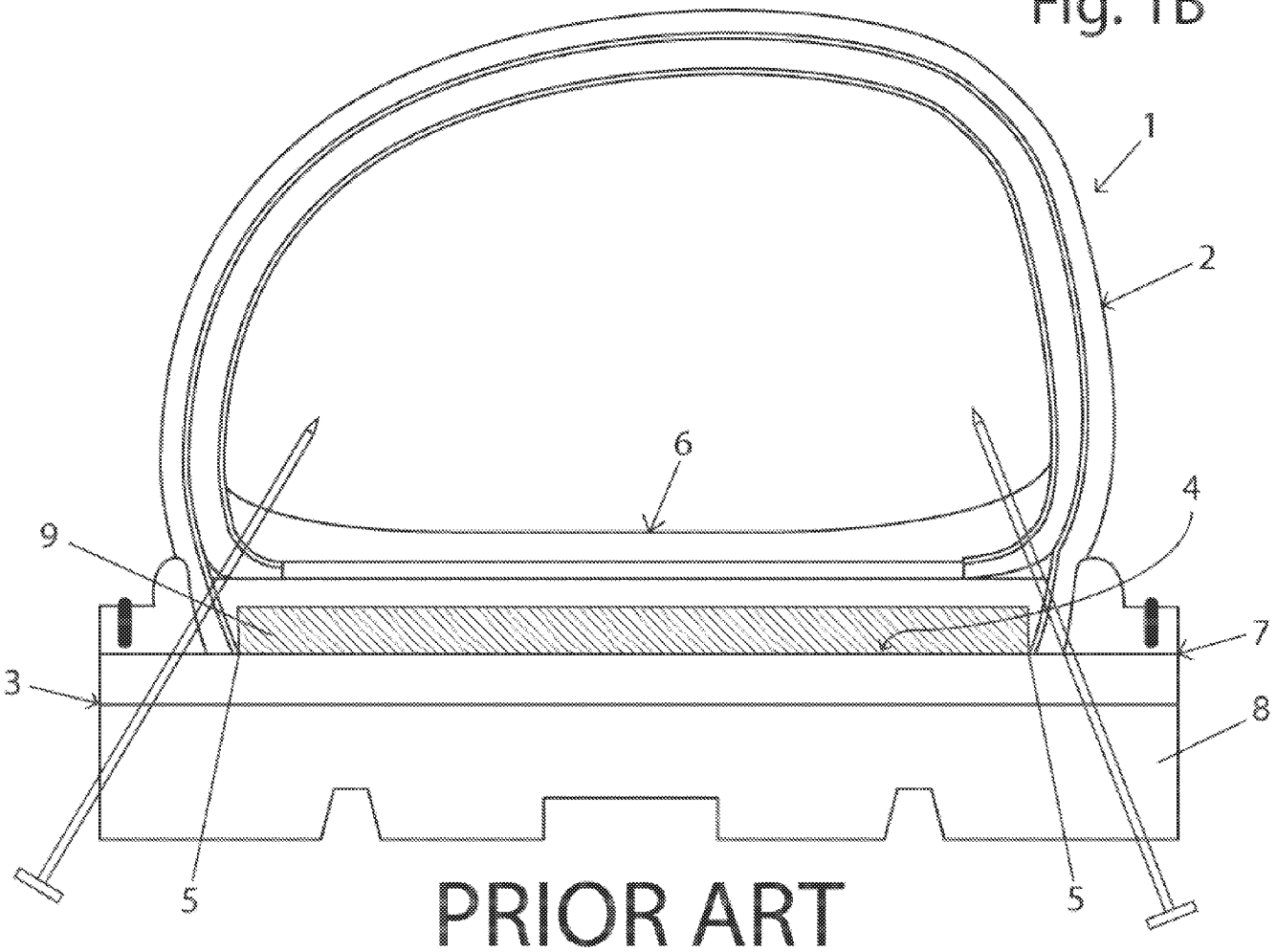
FIG. 1B is a front cross-section view of an item of footwear with sole protection in accordance with the prior art, with pointy objects penetrating through the sole into the upper.

The puncture resistant layer 18 may be embedded into the sole 14. As illustrated in FIG. 2, the puncture resistant layer 18 is embedded into the midsole layer 54. The puncture resistant layer 18 has an outer edge 80 exceeding the inner perimeter 60, for instance about the full periphery of the perimeter 60. This feature has the advantage of increasing the wearer's foot protection because the surface of the puncture resistant layer 18 within the midsole layer 54 is larger than the inner perimeter 60, thereby reducing the risk of penetration of pointy rigid objects through the sole 14 into the upper 12, adjacent the inner perimeter 60 defined by the junction 16 between the upper 12 and the sole 14 as illustrated in FIG. 1B.

In at least one embodiment, the outer edge 80 of the puncture resistant layer 18 exceeds the inner perimeter 60 by at least 3 mm, for instance over the full periphery of the perimeter 60, or over a major portion of the periphery of the perimeter 60. In at least another embodiment, the outer edge of the puncture resistant layer 18 exceeds the inner perimeter 60 by at least 8 mm, for instance over the full periphery of the perimeter 60, or over a major portion of the periphery of the perimeter 60. In these configurations, the puncture resistant layer 18 covers a surface within the sole portion 14 that is larger than the inner perimeter 60 of the item of footwear 10.

Figure 3:
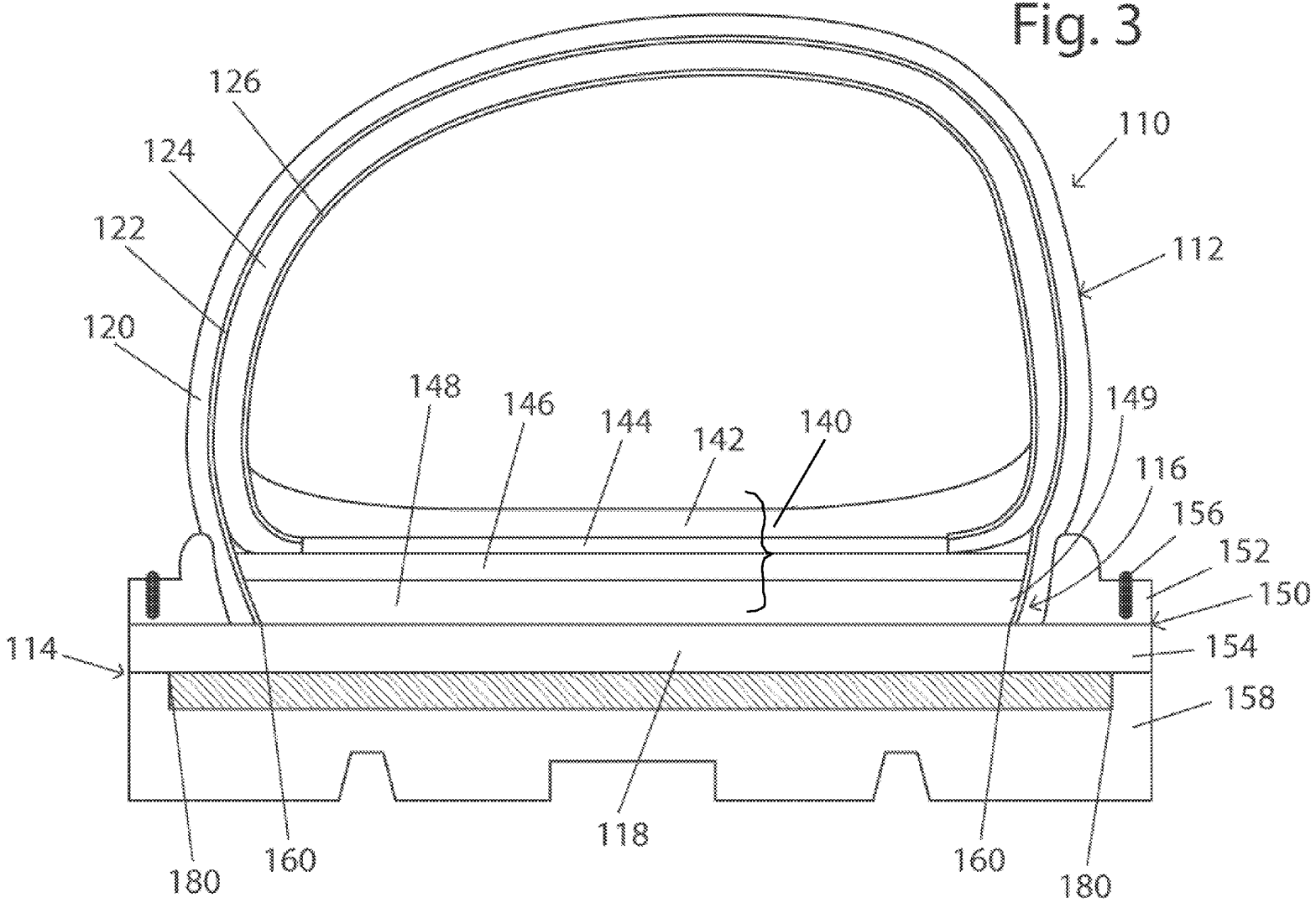
FIG. 3 is a front cross-section view of an item of footwear with sole protection in accordance with another aspect of the present disclosure.

Referring now to FIG. 3, an item of footwear with sole protection in accordance with another aspect of the present disclosure is shown at 110. As in FIG. 2, the item of footwear 110 has two main parts: an upper 112 and a sole 114 secured to the upper 112. A junction 116 between the upper 112 and the sole 114 defines an inner perimeter of the item of footwear 110. A puncture-resistant layer 118 is provided in the sole 114. The upper 112 may be composed of one or more flexible layer of materials as described above. The upper 112 also comprises an outer layer 120, a backing reinforcement 122, a protective toe-cap 124 and/or an inner liner 126.

The upper 112 also comprises an insole 140. As illustrated in FIG. 3, a removable sock liner 142 may be within the foot-receiving cavity of the upper, and lies on a top surface of the insole 140. By way of example, the insole 140 comprises various layers, such as insole layers 144, 146 and 148. The insole layer 144 may be made of cellulosic paper or synthetic non woven material. The insole layer 146 may be made of cushioning material such as urethane, latex and/or EVA, which provide wearing comfort of the item of footwear. The insole layer 148 may be an insole board. Any other configuration is considered for the insole 140, with one or more layers. As illustrated in FIG. 3, the upper 112 is connected at least along an outer edge 149 of the insole 140.

As illustrated in FIG. 3, the sole 114 is made of two different layers: the midsole 150 and the outsole 158. The midsole 150 is connected to the upper 112. The midsole 150 may also comprises two superimposed portions: the welt 152 and the midsole layer 154. As shown in FIG. 3, the welt 152 is connected by a direct injection molding process to the upper 112 and provides a decorative stitch line 156. The outsole 158 is adapted to be the interface between the wearer and the ground. The outsole adheres to the midsole 154.

It is observed from FIG. 3 that the inner perimeter 160 of the upper 112 is generally defined by the intersection between the upper 112 and the sole 114. The inner perimeter 160 may define the boundary delimiting the inner cavity of the upper 112 that receives the foot of the wearer.

As illustrated in FIG. 3, the puncture resistant layer 118 is embedded into the outsole 158. The puncture resistant layer 118 has an outer edge 180 exceeding the inner perimeter 160 of the item of footwear 110 defined by the junction 116 between the upper 112 and the sole 114.

Figure 4:
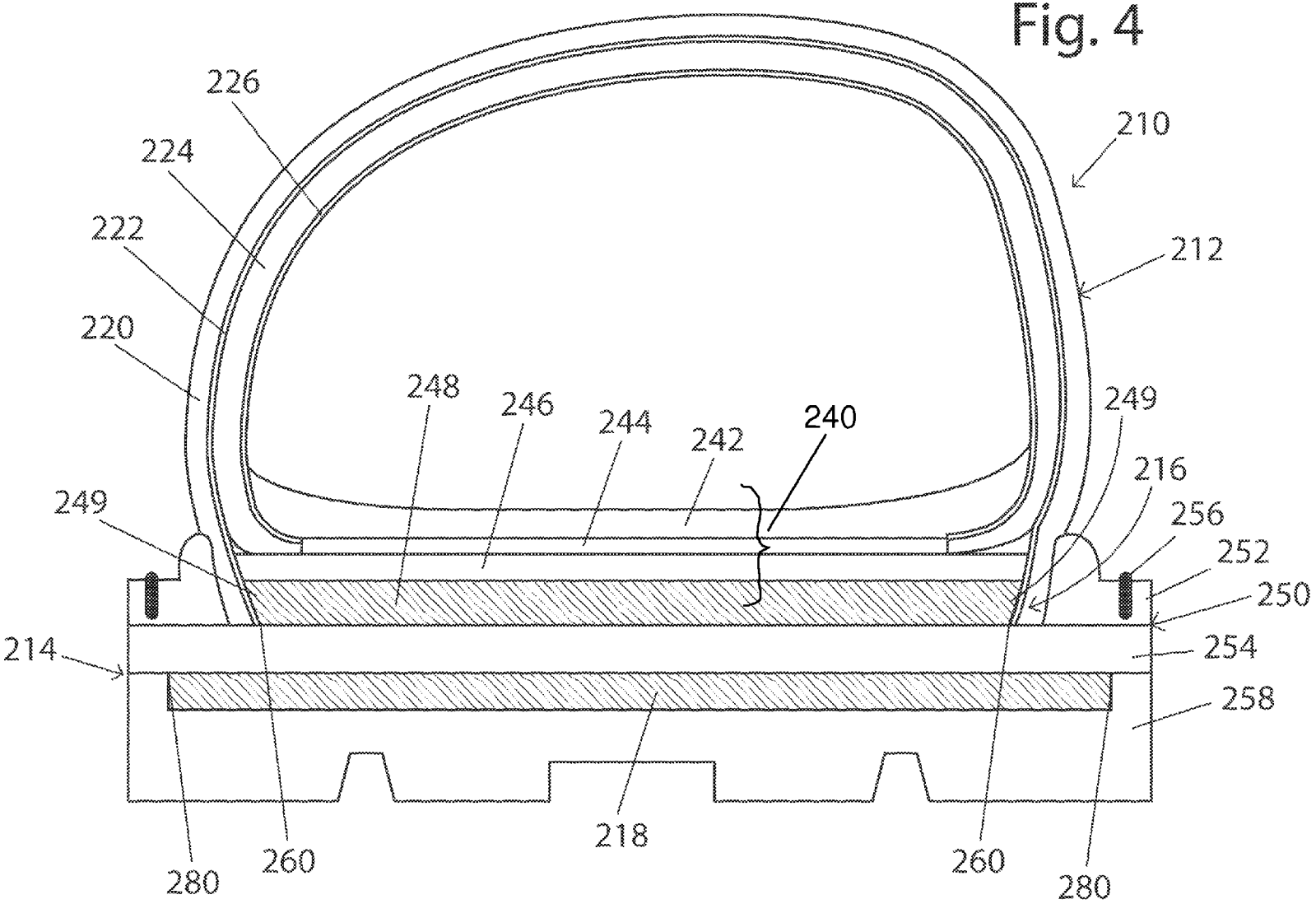
FIG. 4 is a front cross-section view of an item of footwear with sole protection in accordance with still another aspect of the present disclosure.

Turning to FIG. 4, an item of footwear with sole protection in accordance with a further aspect of the present disclosure is shown at 210. As in FIGS. 2 and 3, the item of footwear 210 has two main parts: an upper 212 and a sole 214 secured to the upper 212. A junction 216 between the upper 212 and the sole 214 defines an inner perimeter of the item of footwear 210. A puncture-resistant layer 218 is provided in the sole 114. The upper 212 may be composed of one or more flexible layers of materials as described above. The upper 212 also comprises an outer layer 220, a backing reinforcement 222, a protective toe-cap 224 and/or an inner liner 226.

The upper 212 also comprises an insole 240. As illustrated in FIG. 4, a removable sock liner 242 may be within the foot-receiving cavity of the upper, and lies on a top surface of the insole 240. By way of example, the insole 240 comprises various layers, such as insole layers 244, 246 and 248. The insole layer 244 may be made of cellulosic paper or synthetic non woven material. The insole layer 246 may be made of cushioning material such as urethane, latex and/or EVA, which provide wearing comfort of the item of footwear. The insole layer 248 may be a puncture-resistant layer. Any other configuration is considered for the insole 240, with one or more layers. As illustrated in FIG. 3, the upper 212 is connected at least along an outer edge 249 of the insole 240.

As illustrated in FIG. 4, the sole 214 may be made of two different layers: the midsole 250 and the outsole 258. The midsole 250 is connected to the upper 212. The midsole 250 may also comprises two superimposed portions: the welt 252 and the midsole layer 254. As shown in FIG. 4, the welt 252 is connected by a stitch 256 to the upper 212. The outsole 258 is adapted to be the interface between the wearer and the ground. The outsole 258 adheres to the midsole 254.

It is observed from FIG. 4 that the inner perimeter 260 of the upper 212 is generally defined by the intersection between the upper 212 and the sole 214. The inner perimeter 260 may define the boundary delimiting the inner cavity of the upper 212 that receives the foot of the wearer.

As illustrated in FIG. 4, the item of footwear 210 comprises a first puncture resistant sole 218 embedded into the outsole 258 and a second puncture resistant sole 248 embedded in the insole 240. The first puncture resistant layer 218 has an outer edge 280 exceeding the inner perimeter 260 of the item of footwear 210 defined by the junction 216 between the upper 212 and the sole 214. The outer edge 280 of the first puncture resistant layer 218 also exceeds the perimeter 260 of the insole 240 comprising the embedded second puncture resistant layer 248. This later configuration has the advantage of further increasing the sole protection and reducing the risk against the penetration into the upper 212 of, for example, nails with smaller head.

In at least one embodiment, the puncture resistant layer 18, 118, 218 comprise a single layer, or may be an assembly of separate layers of materials, such as, for example steel or other metallic materials, high tensile strength synthetic, polymeric fibers, a combination of these material, for instance in a woven state and/or in multiple layers, and the like. The layers 18, 118, 218 are said to be puncture resistant, in that their resistance to puncture is substantially greater per thickness unit than that of the material(s) of the sole 14, 114, 214. For instance, the puncture resistant layers are made from one or more layers (e.g., up to seven layers) made of a high-tenacity tightly woven non-metallic textile (e.g., nylon woven fabric). In at least another embodiment, the puncture resistant layer 18, 118, 218 may comprises one layer of a puncture resistant material that may withstand a force of at least 1200 Newton when tested according to protective footwear standard CAN/CSA Z195-09 clause 6.3.1. In still another embodiment, the puncture resistant layer 18, 118, 218 may comprise two layer of the puncture resistant material described above. The latter may withstand a force of at least 2500 Newton when tested according to protective footwear standard CAN/CSA Z195-09 clause 6.3.1. The puncture resistant layers may comply with such standards, or other standards like ASTM F2412/13, EN ISO 12568, or EN ISO 20344/45, among numerous other standards.

Figure 5:
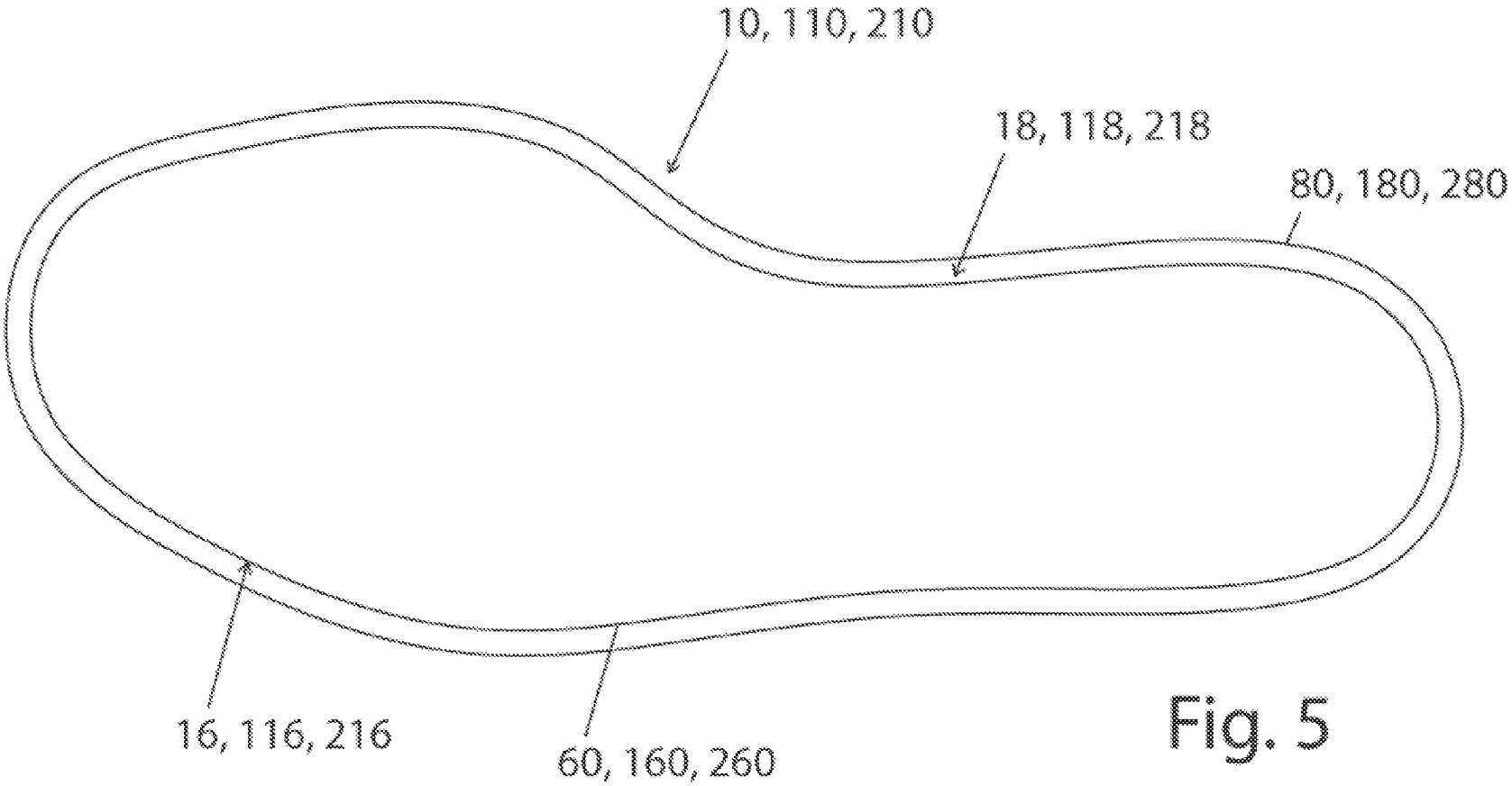
FIG. 5 is a top schematic view of a configuration of a puncture resistant layer and an inner perimeter defined by the junction between the upper and the sole of the item of footwear of FIGS. 2, 3, and 4.

Referring to FIG. 5, a configuration of a puncture resistant layer 18, 118, 218 and an inner perimeter 60, 160, 260 of the item of footwear 10, 110, 210 in accordance with FIGS. 2, 3, and 4 is illustrated. In this configuration, the outer edge 80, 180, 280 of the puncture resistant layer 18, 118, 218 clearly exceeds the inner perimeter 60, 160, 260 defined by the junction 16, 116, 216 between the upper 12, 112, 212 and the sole 14, 114, 214 of the item of footwear 10, 110, 210. Therefore, FIG. 5 demonstrates that the puncture resistant layer 18, 118, 218 embedded in the sole 14, 114, 214 in accordance with the present disclosure offers an improved sole protection against penetration of nails, screws or other similar sharp and rigid objects by covering a surface within the sole 14, 114, 214 that is larger than the inner perimeter 60, 160, 260 defined by the junction 16, 116, 216 between the upper 12, 112, 212 and the sole 14, 114, 214 of the item of footwear 10, 110, 210. In FIG. 5, the inner perimeter 60, 160, 260 is projected onto a plane of the puncture resistant layer 18, 118, 218, to illustrates how the perimeter of the layer 18, 118, 218 exceeds the perimeter of the inner perimeter 60, 160, 260. For an item of footwear US size 8.0, the surface of protection may be increased by at least 15% and 25% with outer edge 80, 180, 280 offset by 5 mm and 8 mm respectively from inner perimeter 60, 160, 260. It is shown that the outer edge (i.e., perimeter) of the layer 18, 118, 218 exceeds the inner perimeter 60, 160, 260 completely (i.e., around the full inner perimeter 60, 160, 260). However, there may be some disruption in this excess perimeter. For instance, as the heel portion of the sole 14, 114, 214 may be thicker than a remainder of the sole 14, 114, 214, it is considered not to have the layer 18, 118, 218 extend beyond the inner perimeter 60, 160, 260 in the heel region. The perimeter of the layer 18, 118, 218 exceeds the inner perimeter 60, 160, 260 over at least a major portion of the sole.

The final product is an item of footwear featuring an improved sole protection against the penetration of sharp and rigid objects through the sole into the upper.

The invention claimed is:

1. An item of footwear with sole protection comprising:

an upper adapted to receive a foot of the wearer;

a sole secured to the upper and adapted to be the interface between the wearer and the ground, the sole having at least an outsole and a midsole adhered to the outsole, an inner perimeter of the item of footwear defined by a junction between the upper and the sole, and an outer perimeter of the sole defining the outer perimeter of the footwear; and a puncture-resistant layer embedded in the sole so as to provide puncture protection for the foot of the wearer, the puncture resistant layer having an outer edge extending beyond at least a portion of the inner perimeter, the outer perimeter extending beyond the outer edge to create a section of direct contact between the midsole and the outsole, the section of direct contact surrounding the outer edge of the puncture resistant layer such that the section of direct contact is free of puncture-resistance layer, the puncture-resistant layer capable of withstanding a penetration force of 1200 N by a standard test pin at a rate of traverse penetration of a maximum of 0.432 inch per minute.

2. The item of footwear of claim 1, wherein the puncture-resistant layer is at a junction between the midsole and the outsole.

3. The item of footwear of claim 2, wherein the puncture resistant layer is embedded into the midsole and peripherally bound by the midsole.

4. The item of footwear of claim 2, wherein the puncture-resistant layer is embedded into the outsole and peripherally bound by the outsole.

5. The item of footwear of claim 1, wherein the outer edge of the puncture-resistant layer exceeds the inner perimeter by at least 3 mm.

6. The item of footwear of claim 1, wherein the outer edge of the puncture-resistant layer exceeds the inner perimeter by at least 8 mm.

7. The item of footwear of claim 1, wherein the item of footwear comprises an insole in the upper, another puncture-resistant layer being in the insole.

8. The item of footwear of claim 1, wherein the outer edge of the puncture-resistant layer extends beyond the inner perimeter about a complete periphery of the item of footwear.

* * * * *